US008408666B2

(12) United States Patent
Armstrong et al.

(10) Patent No.: US 8,408,666 B2
(45) Date of Patent: Apr. 2, 2013

(54) UNDER SHELF MOUNTED DRAWER

(75) Inventors: William Armstrong, Huntersville, NC (US); Christopher J. Claypool, Huntersville, NC (US); Bradley S. Hooley, Charlotte, NC (US); Michael Schumann, New York, NY (US); Stian Tesdal, New York, NY (US); Anthony Torris, Montclair, NJ (US); Allen Zadeh, Brooklyn, NY (US)

(73) Assignee: Rubbermaid Incorporated, Huntersville, NC (US)

( * ) Notice: Subject to any disclaimer, the term of this patent is extended or adjusted under 35 U.S.C. 154(b) by 0 days.

(21) Appl. No.: 13/115,984

(22) Filed: May 25, 2011

(65) Prior Publication Data

US 2012/0074825 A1 Mar. 29, 2012

Related U.S. Application Data

(60) Provisional application No. 61/348,217, filed on May 25, 2010.

(51) Int. Cl.
*A47B 96/02* (2006.01)

(52) U.S. Cl. ..... 312/408

(58) Field of Classification Search ..... 312/322, 312/323, 327, 328, 404, 408, 247
See application file for complete search history.

(56) References Cited

U.S. PATENT DOCUMENTS 933,517 A 9/1909 Worcester
1,089,845 A 3/1914 Long
2,140,611 A 12/1938 Smith et al.
2,242,903 A 5/1941 Crimmel
2,490,426 A 12/1949 Gerdeman
2,676,863 A * 4/1954 Cooper ..... 312/246
2,839,349 A * 6/1958 Culver ..... 312/323
2,888,146 A 5/1959 Teas, Jr.
2,914,191 A 11/1959 Bowden et al.
3,007,580 A 11/1961 Dickson, Jr.
3,565,504 A * 2/1971 Brown ..... 312/270.3
3,741,131 A 6/1973 Leadbetter
3,752,323 A 8/1973 Kayden
4,004,526 A 1/1977 King
4,241,668 A 12/1980 Carroll
4,368,866 A * 1/1983 Urban ..... 248/286.1
4,456,125 A 6/1984 Chap
4,597,616 A 7/1986 Trubiano
(Continued)

*Primary Examiner* — James O Hansen
*Assistant Examiner* — Matthew Ing
(74) *Attorney, Agent, or Firm* — Lempia Summerfield Katz LLC

(57) ABSTRACT

A drawer assembly for mounting beneath a shelf has a drawer and a mounting unit. The drawer has a bottom, a front end, a rear end, and a pair of opposed side panels. The mounting unit is configured to mount to a shelf and has a pair of spaced apart drawer supports that support the drawer under a shelf. A pair of laterally spaced apart tracks is provided on either the drawer side panels or the mounting unit drawer supports. A pair of lugs protrudes from each of the other of the drawer side panels or the mounting unit drawer supports. Each pair of lugs is slidable relative to and along a respective one of the tracks. The drawer is slidable between a closed position and an open position relative to the mounting unit. The tracks and lugs cooperate such that the front end and rear end of the drawer are substantially level with one another in the closed position and the front end is lower than the rear end in the open position.

10 Claims, 9 Drawing Sheets

U.S. PATENT DOCUMENTS

| | | | | |
|---|---|---|---|---|
| 4,673,089 | A | | 6/1987 | Chap |
| 4,729,613 | A | * | 3/1988 | Tromble et al. ..... 312/270.3 |
| 4,765,575 | A | | 8/1988 | Bergl et al. |
| 4,792,195 | A | | 12/1988 | Adriaansen et al. |
| 4,795,041 | A | | 1/1989 | Remmers |
| 4,807,764 | A | | 2/1989 | Bellin |
| 5,036,990 | A | | 8/1991 | Verchere |
| 5,244,272 | A | | 9/1993 | Thompson |
| 5,317,977 | A | | 6/1994 | Omessi |
| D348,904 | S | | 7/1994 | Linder |
| 5,509,634 | A | | 4/1996 | Gebka et al. |
| 5,524,957 | A | | 6/1996 | Gibriano |
| 5,524,981 | A | * | 6/1996 | Herrmann et al. ..... 312/408 |
| 5,655,670 | A | | 8/1997 | Stuart |
| 5,664,689 | A | | 9/1997 | Mirlisena |
| D386,921 | S | | 12/1997 | Wikman |
| 5,695,163 | A | | 12/1997 | Tayar |
| 5,931,316 | A | | 8/1999 | Carpinelli |
| 5,957,558 | A | | 9/1999 | Quade |
| 6,079,680 | A | | 6/2000 | Kochanski et al. |
| 6,318,567 | B1 | | 11/2001 | Braley |
| 6,435,634 | B1 | | 8/2002 | Webb et al. |
| 6,527,235 | B1 | | 3/2003 | Cotterill |
| 6,578,720 | B1 | | 6/2003 | Wang |
| D505,581 | S | | 5/2005 | Glass et al. |
| D525,811 | S | | 8/2006 | Nawrocki |
| 7,100,882 | B2 | | 9/2006 | Behroozi |
| 7,140,703 | B1 | * | 11/2006 | Holdgate et al. ..... 312/323 |
| 7,165,798 | B2 | * | 1/2007 | Chamberlain et al. ..... 296/37.1 |
| 2005/0188903 | A1 | | 9/2005 | Ryberg |
| 2006/0113443 | A1 | | 6/2006 | Remmers |
| 2008/0074021 | A1 | | 3/2008 | Croft et al. |
| 2009/0108723 | A1 | | 4/2009 | Chute et al. |

* cited by examiner

UNDER SHELF MOUNTED DRAWER

RELATED APPLICATION DATA

This patent is related to and claims priority benefit of U.S. provisional application Ser. No. 61/348,217 entitled "Kitchen and Pantry Organization" and filed on May 25, 2010. The entire content of this prior filed provisional application is hereby incorporated by reference herein.

BACKGROUND

1. Field of the Disclosure

The present disclosure is generally directed to storage and organization products, and more particularly to a drawer that can be mounted under a shelf.

2. Description of Related Art

Most modern kitchen designs and kitchen redesigns are configured for optimal usage of storage space. Older kitchens were typically also designed with storage space as an important concern, but only with then-existing storage accessory technology in mind. Still, many older and more modern kitchens include cabinet systems and other storage elements that include a large volume of potential storage space that is either not utilized at all, or that is underutilized. Kitchen cabinets and pantry shelving units are typically designed to include a number of vertically spaced apart shelves. Depending on the type of objects that are to be stored in a particular portion of a cabinet, pantry, or other shelving unit, unused or underutilized storage space can typically be found directly beneath one or more of the shelves.

Some consumers may attempt to adapt and utilize this storage space using some type of storage accessory. However, known solutions typically offer limited accessibility to the storage accessory or space. Some consumers may attempt to utilize the storage space without the use of any type of accessory. However, the stored items themselves may be highly inaccessible and difficult to reach. This is because the stored items may be stored or stacked on top of other items and rest directly under the overlying shelf surface and/or may be located in the rearward most recesses of the storage area.

A number of solutions have been developed that attempt to utilize this under shelf storage space in order to better organize kitchen cabinets, pantries, and the like. One example includes wire drawers that screw or clamp onto and under a wire shelving unit. Such drawers can be pulled straight out horizontally forward in a conventional manner from under the shelf. When the drawer pulls straight out, and particularly in a storage area of limited space, such as a pantry, the drawer interior can be difficult to access. It can also be difficult to remove stored items from the drawer, particularly longer or larger stored items.

Another example includes hanging or suspending fixed additional sub-shelves or fixed baskets from the underside of an existing shelf. These accessories are configured to try and take advantage of this underutilized or unused storage space. However, it can be difficult for a user to grasp or even to reach the rearward most items stored on such sub-shelves or baskets. This is because such units are typically fixed in position under or on the shelf and because the space between the prior existing shelf and/or the surface or surfaces of the sub-shelf or basket can be rather small. The opening between the shelf above such a unit and the storage surface of the sub-shelf or basket can also be relatively small, making it difficult for a user to reaching, grasp, and remove a stored item.

SUMMARY

In one example according to the teachings of the present invention, a drawer assembly for mounting beneath a shelf has a drawer with a bottom, a front end, a rear end, and a pair of opposed side panels. A mounting unit is configured to mount to a shelf and has a pair of spaced apart drawer supports. The drawer is supported by the drawer supports under the shelf. A pair of laterally spaced apart tracks is on either the drawer side panels or the mounting unit drawer supports. A pair of lugs protrudes from each of the other of the drawer side panels or the mounting unit drawer supports. Each pair of lugs is slidable relative to and along a respective one of the tracks. The drawer is slidable between a closed position and an open position relative to the mounting unit. The tracks and lugs cooperate such that the front end and rear end of the drawer are substantially level with one another in the closed position and the front end is lower than the rear end in the open position.

In one example, each pair of lugs further can include a forward lug and a rear lug spaced apart from one another.

In one example, each pair of lugs can include a forward lug and a rear lug spaced apart from one another and protruding outward from the side panels of the drawer.

In one example, each rear lug can be positioned adjacent the rear end of the drawer and each forward lug can be positioned spaced from the both the respective rear lug and the front end of the drawer.

In one example, each of the tracks can be carried on an inside surface of a respective one of the mounting supports.

In one example, each of the tracks can have a lower guide and an upper guide defining a track slot therebetween. The lower guide can have a relatively horizontal rear segment, a front segment at a lower elevation than the rear segment, and an inclined segment therebetween and connecting the rear and front segments.

In one example, the track slot can have a rear portion, an inclined portion, and a front portion that correspond to and have a contour determined by the respective rear, inclined, and front segments of the lower guide.

In one example, the drawer can slide forward a predetermined distance from the closed position before the front end of the drawer begins to drop downward.

In one example according to the teachings of the present invention, a drawer assembly for mounting beneath a shelf has a drawer with a bottom, a front end, a rear end, a pair of opposed side panels, and lugs protruding outward from each side panel. A mounting unit is configured to mount to a shelf and has a pair of laterally spaced apart tracks. The drawer is supported by the mounting unit with the lugs on each side panel and is slidable along a respective one of the tracks. The drawer is slidable between a closed position and an open position relative to the mounting unit. The bottom is substantially level in the closed position being tilted downward from the rear end toward the front end in the open position.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The drawer assembly disclosed and described herein solves or improves upon one or more of the above-noted and/or other problems and disadvantages with prior known storage solutions for kitchens, pantries, and the like. A drawer assembly is disclosed herein that easily mounts to the underside of an existing shelf. The drawer assembly disclosed herein has a drawer that provides easy access to items stored in the drawer when in an open position. The drawer assembly disclosed herein is oriented in a generally level orientation, such as parallel to a horizontal shelf, when in the closed position. When moved to the open position, the drawer assembly tilts forward and downward so that the front end of the drawer is lower than the rear and. This provides a greater access area or opening and easier access to the items stored in the drawer. This can also make it easier for a user to remove larger or longer items stored in the drawer.

Figure 1:
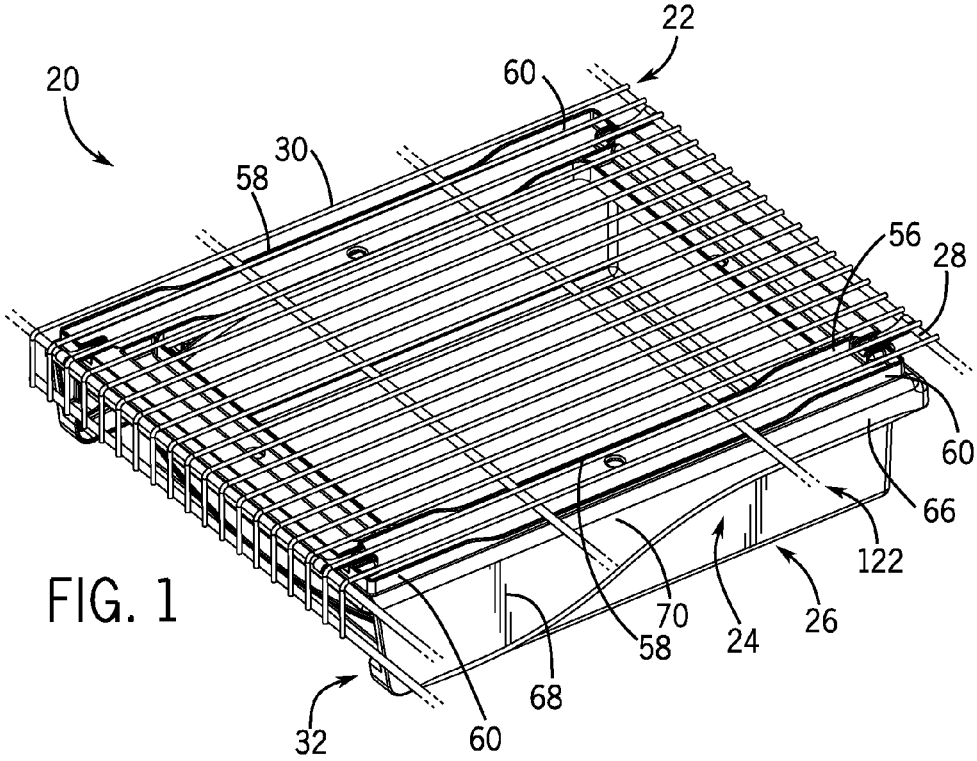
FIG. 1 shows a perspective view of one example of a drawer assembly constructed in accordance with the teachings of the present invention, and shows the drawer in a closed position.
Figure 2:
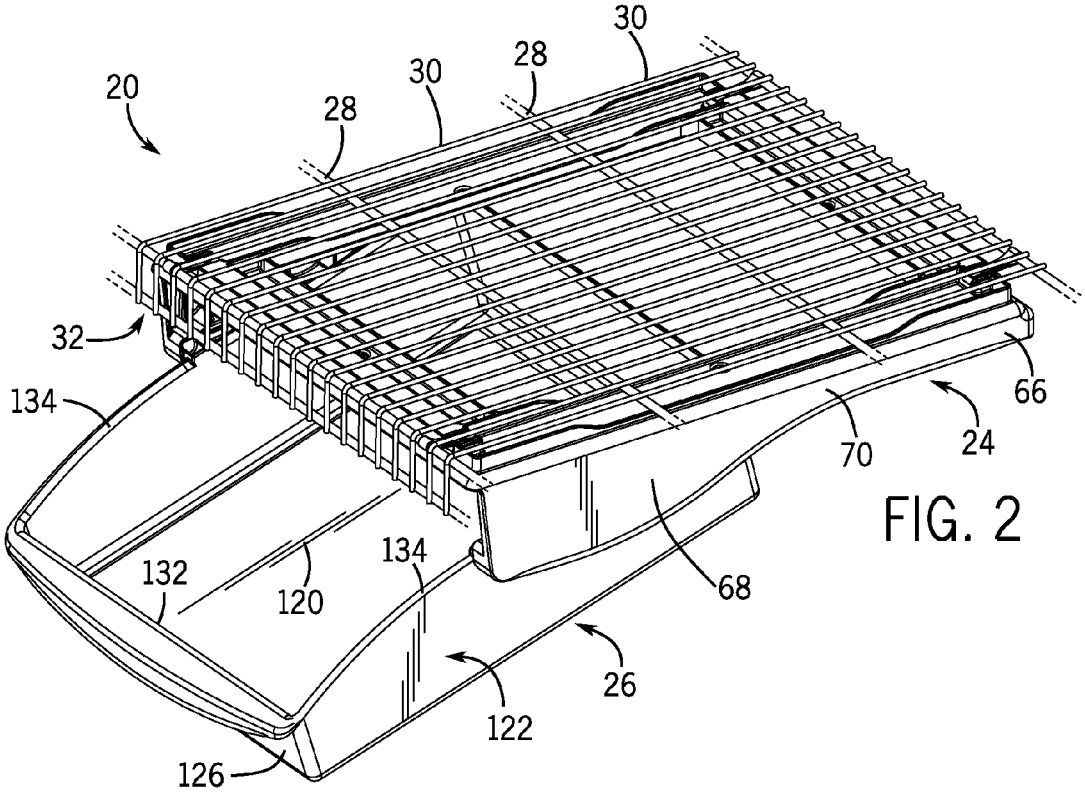
FIG. 2 shows the drawer assembly shown in FIG. 1 with the drawer in an open position.

Turning now to the drawings, FIGS. 1 and 2 show one example of a drawer assembly 20 constructed in accordance with the teachings of the present invention. In this example, the drawer assembly 20 includes a conventional wire shelf 22, a mounting unit 24 suspended from or mounted to the shelf, and a drawer 26 supported by the mounting unit. As utilized herein, the phrase "drawer assembly" can mean a combination of a shelf, a mounting unit, and a drawer, or a combination of only a mounting unit and a drawer.

The type of shelf for which the drawer 26 and mounting unit 24 can be configured can vary within the spirit and scope of the present invention. The shelf can be a solid plank, a wire form structure, or the like. In this example, the shelf 22 is a wire form structure having a conventional construction. The shelf 22 has a plurality of laterally extending support wires 28 supporting and welded to a plurality of front to back extending surface wires 30. The front of the shelf 22 has a downturned face 32, as is known in the art, to provide structural integrity and stiffness to the shelf.

The drawer 26 is movable relative to both the mounting unit 24 and the shelf 22 between a closed position as shown in FIG. 1 and an open position as shown in FIG. 2. In general, the drawer 26 is oriented level with a plane of the shelf 22, such as a horizontal plane, in the closed position, which is a standard drawer orientation. However, the drawer 26 in this example is tilted downward and forward in the open position, which provides easier access to the contacts stored within the drawer. In addition, the drawer assembly 20 can be mounted at virtually eye level and still allow a user to view inside the drawer when the drawer is in the open position without the user having to stand on a stool or on their toes.

With reference to FIGS. 3-9, the mounting unit 24 generally has a mounting structure 40 and a pair of drawer supports 42. The drawer supports 42 depend from the sides of the unit and oppose one another across the unit. The mounting structure 40 is configured to connect the mounting unit 24 to the shelf 22 and to provide some structural integrity to the unit. The mounting structure 40 can be an open structure or a closed or contiguous panel structure, if desired. In this example, the mounting structure 40 has a central opening 44 surrounded and defined by a rectangular bracket 46. The rectangular bracket 46 has four corners, including front corners 48*a* and rear corners 48*b*, a top side 50, and an underside 52. A mounting pad 54 is formed on the topside 50 at or adjacent each of the corners 48*a*, 48*b* in this example.

The bracket 46 and the mounting structure 40 in general can take on a number of different configurations and constructions without departing from the spirit and scope of the present invention. In addition, the mounting structure 40 can include a variety of structural elements configured to enhance the ornamental aspects of the product and/or to increase or improve the structural integrity of the mounting unit 24. For example, the central opening 44 in this example is surrounded by an intermittent upstanding inner wall 56 of varying height. The inner wall 56 projects upward from the top side 50 of the bracket 46 around the central opening 44. The intermittent nature or varying height of the inner wall 56 can be configured to accommodate structures on the shelf 22. For example, low points 58 on the wall 56 can be positioned to provide clearance for parts of the shelf, such as the support wires 28 in this example (see FIG. 1). These features can provide clearance between the mounting unit 24 and the wires 28 or other components on the shelf 22. In this example, a second outstanding outer wall 60 also projects upward from the top side 50 of the bracket 46. The second or outer wall 60 is spaced radially outward of and surrounds the first or inner wall 56, defining a gap therebetween. This gap can also be to provide clearance for components on the shelf, such as the surface wires 30

The bracket 46 in this example also has a downturned front lip 62 that depends forward and downward from a front edge of the bracket between the front corners 48*a*. A rear skirt 64 also projects downward from the bracket 46 on a rear edge of the bracket and between the rear corners 48*b*. These features can add additional structural integrity and/or ornamentation to the finished product.

Figure 9:
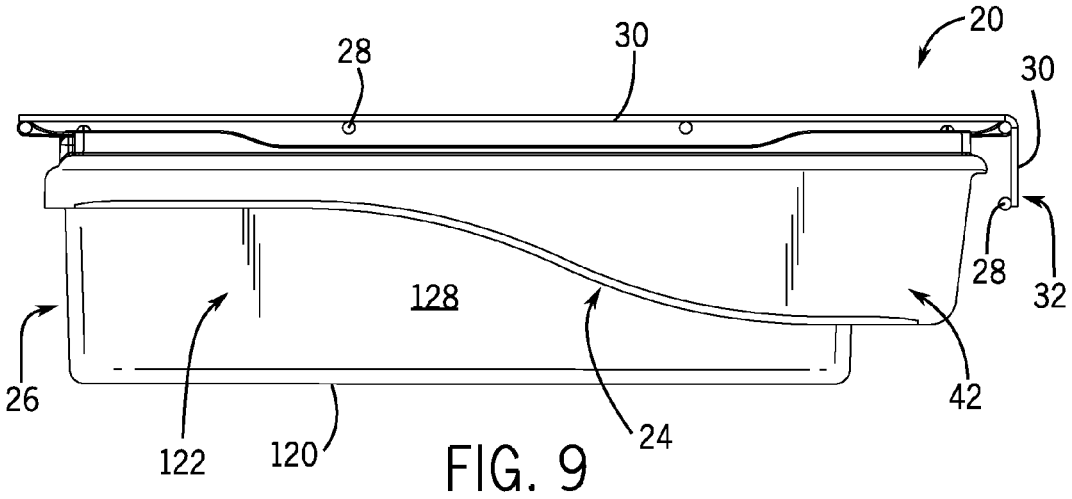
FIG. 9 shows a right side view of the drawer assembly shown in FIG. 1, wherein the left side view can essentially be a minor image thereof.

Each of the drawer supports 42 is an integral continuation of the bracket 46 and depends downward from the side edges of the bracket. A rear section 66 of the drawer supports 42 integrally joins the rear skirt 64 around the rear corners 48*b*. Each of the drawer supports 42 also has a front section 68 that starts at about the front corners 48*a*. The front sections 68 are longer and therefore depend further downward from the bracket 46 in comparison to the rear sections 66. A midsection 70 interconnects the front section 66 with the rear section 68 on each of the drawer supports 42. The midsection 70 provides a smooth, continuous, gradual, curved transition between the front and rear sections, as can be seen in FIGS. 3 and 9.

Each of the drawer supports 42 can be connected to the bracket 46 and formed integrally therewith from the same material. One or more ribs, webs, buttresses, or the like can be formed on the various surfaces of the drawer supports 42 and/or the bracket 46 to add structural rigidity and strength to the mounting unit 24, as desired. For example, a pair of larger ribs 72 are integrally formed projecting from and connected to both the inside surfaces 74 on the front sections 66 of the drawer supports 42 and the underside 52 of the bracket 46. A pair of smaller ribs 76 is similarly constructed and projects from both the inside surfaces 74 on the rear section 66 and the underside 52. These example ribs are visible in FIG. 3, but the structural features of the mounting unit can vary considerably from these examples.

Figure 3:
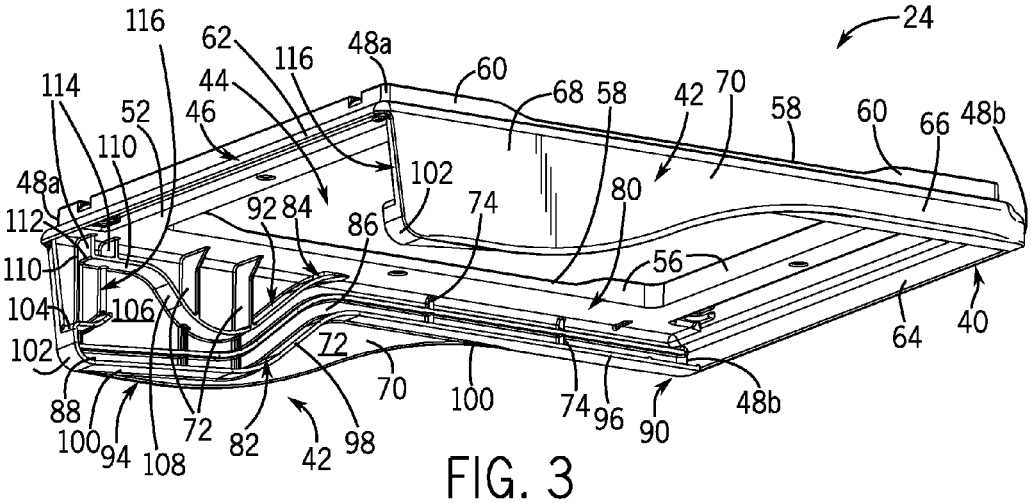
FIG. 3 shows a bottom perspective view of the mounting unit of the drawer assembly shown in FIG. 1.
Figure 4:
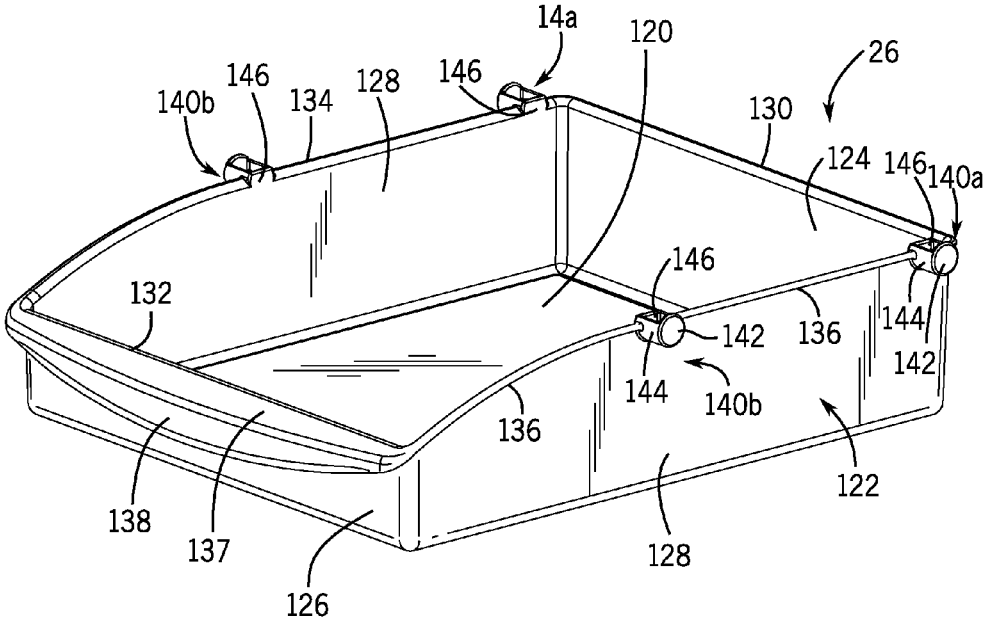
FIG. 4 shows a top perspective view of the drawer of the drawer assembly shown in FIG. 1.
Figure 5:
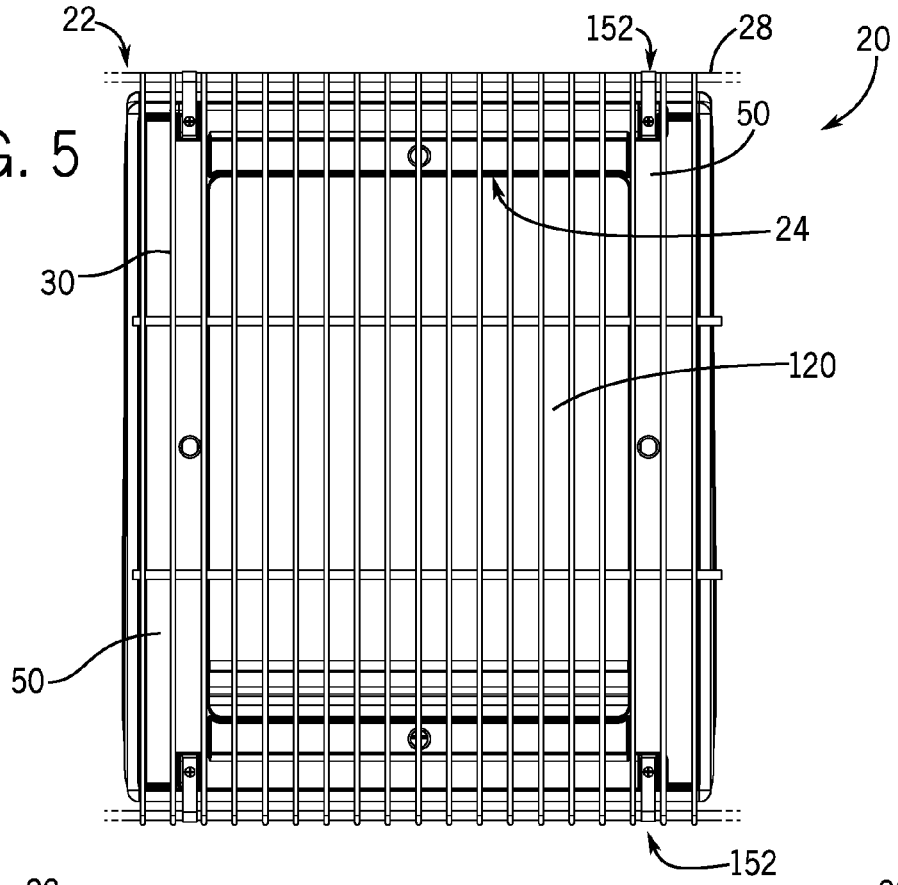
FIG. 5 shows a top view of the drawer assembly shown in FIG. 1.
Figure 6:
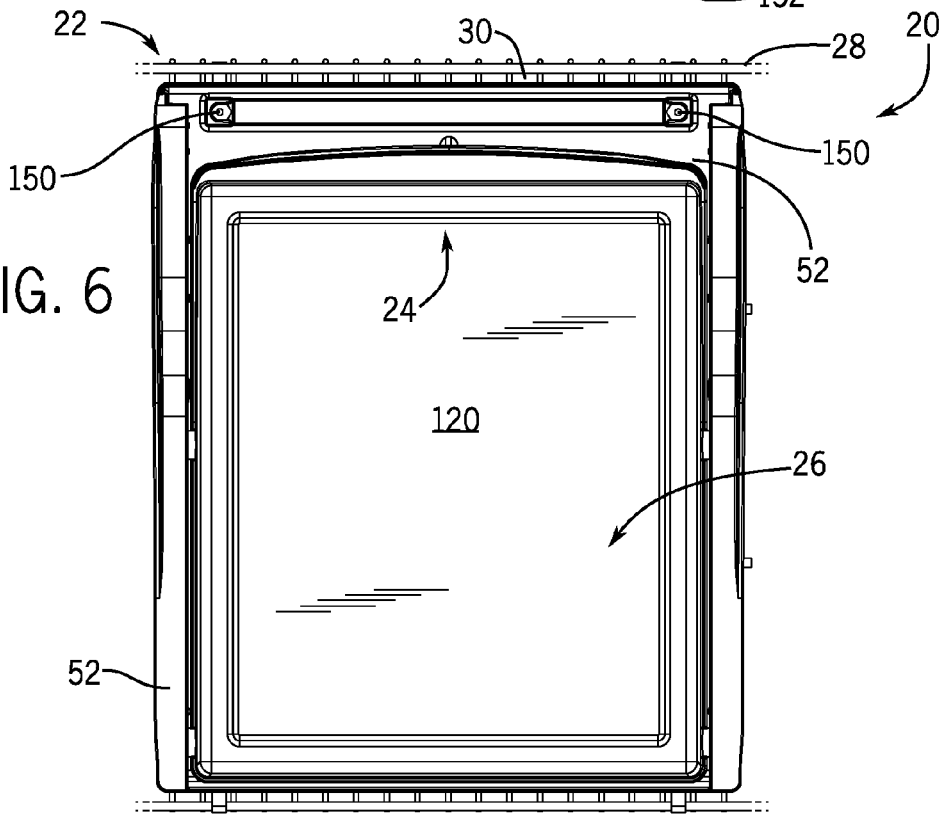
FIG. 6 shows a bottom view of the drawer assembly shown in FIG. 1.
Figure 7:
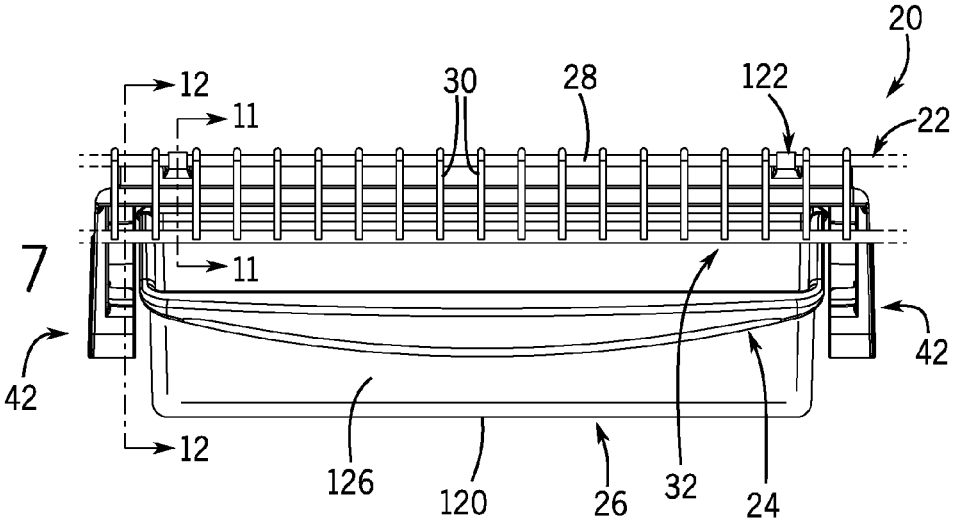
FIG. 7 shows a front view of the drawer assembly shown in FIG. 1.
Figure 8:
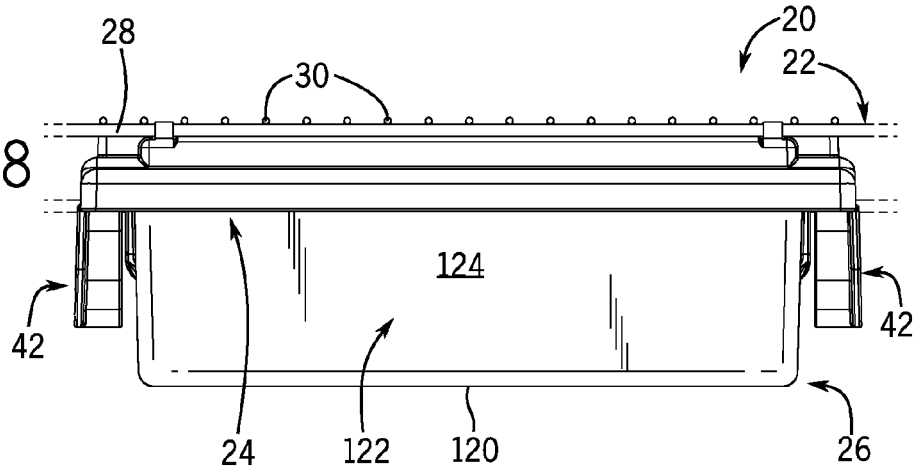
FIG. 8 shows a rear view of the drawer assembly shown in FIG. 1.

As shown in FIG. 3, a track 80 is defined on the inside surface 74 of each of the drawer supports 42. Each track 80 has a lower guide 82 protruding inward from the inside surface 74 and extending back to front along the drawer support. Each track 80 also has an upper guide 84 spaced upward from the lower guide 82 and also extending back to front along the drawer support. The spacing between the upper and lower guide 82 and 84 define a track slot 86 therebetween. A lug rib 88 also protrudes inward from the inside surface of each drawer support 42. Each lug rib 88 is positioned between the upper and lower guides 84, 82 within the track slot 86. The guides 82, 84 have a larger size and thus project much further inward in comparison to the lug rib 88 for purposes to be discussed.

With reference to FIG. 3, each track 80 generally has a horizontal rear portion 90, an angled or inclined portion 92, and a front portion 94. The inclined portion 92 is between the rear portion 90 and the front portion 94 and connects the two as a continuous track. The upper guide 84 does not extend to the rear portion 90 in this example. Instead, the underside 52 of the bracket 46 defines the part of the upper guide for the rear portion 90. However, in other examples, the upper guide 84 can extend all the way to the rear skirt 64, if desired, or to a rear end of the track slot 86. In this example, the rear skirt 64 can define a rear stop for the track slot 86, if needed.

The lower guide 82 has a rear segment 96 that defines the lower boundary of the rear portion of the track 80. The lower guide 82 also has an inclined segment 98 that defines the lower boundary of the inclined portion 92 of the track 80. The lower guide also has a front segment 100 that defines the lower boundary of the front portion 94 of the track 80.

The upper guide 84 begins at about the inclined portion 92 of the track 80 in this example. Both the upper guide 84 and the lower guide 82 in this inclined portion 92 curve from the horizontal rear portion 92 of the track downward and forward at an angle, such that the track slot 86 also curves downward and forward within the inclined portion. In this example, the lower guide 82 then curves upward into the front segment 100 from the inclined segment 98. However, the front segment, and thus the front portion 94 of the track 82 is still slightly tilted downward and forward, but much less than the inclined portion 92. The front portion 94 can be horizontal as well, if desired.

The lug rib 88 follows the same contour of the lower guide 82 along the entire length of each track 80. A front end 102 of the lower guide front segment 100 curves upward to form a front stop of the track slot 86. The front end 102 then continues to curve back rearward into an overlapping segment over and spaced from the front segment 100. This forms a vertical stop 104 above the front segment 100 at the front end 102. The vertical stop angles upward a short distance and terminates at a distal end 106.

The upper guide 84 curves along with the lower guide 82 from the inclined portion 92 of the track 80 to the front portion 94. However, the upper guide 84 then continues to curve upward into a reverse inclined segment 108, further away from the front segment of the lower guide 82. The reverse inclined portion 108 of the upper guide 84 then curves and transitions to a front horizontal segment 110. The horizontal segment 110 is closely spaced from the underside 52 of the bracket 46 and terminates at a free end 112. Ribs 114 join the horizontal front segment 110 to both the inside surface 74 of the drawer support 42 and the underside 52 of the bracket 46. The ribs 114 help to strengthen and support the horizontal segment 110 and to the mounting unit as a whole. A space or gap is defined between the horizontal front segment 110 of the upper guide 84 and the vertical stop 104 at its distal end 106. The space provides a front opening 116 into the track slot 86 for each of the tracks 80.

The drawer 26 in this example generally has a bottom 120 that is in the form of a closed panel in this example. However, the bottom 120 of the drawer 26 can also be an open grid pattern, a mesh material, a wire form structure, or the like, if desired. The drawer 26 also has an upstanding sidewall 122 extending upward from and around the perimeter of the bottom 120. The sidewall 122 generally has a back panel 124, a front panel 126, and a pair of opposed side panels 128 that join the front and back panels at front corners 129*a* and rear corners 129*b*, creating the sidewall as a contiguous structure. The sidewall 122 generally has a top edge around the perimeter of the drawer. The top edge is defined by an upper edge 130 of the back panel 124, an upper edge 132 of the front panel 126, and an upper edge 134 of each of the side panels 128. The upper edge 130 and the upper edge 132 are generally linear in this example. The upper edges 134 in this example are generally taller toward the back panel 124 and shorter toward the front panel 126 and gradually curve downward in the direction of the front panel. This configuration helps to enlarge the access opening to the drawer when in the open position.

A lip 136 or other type of bead is formed along a majority of the top edge of the sidewall 122 to also add structural integrity, rigidity, and strength to the sidewall structure. The lip 136 has a consistent, relatively small configuration along the upper edge 130 of the back panel 124 and the upper edges 134 of the side panels 128, respectively. A more prominent lip or rim 137 protrudes forward and downward from the upper edge 132 of the front panel 126. A grip tab 138 protrudes even further forward from the rim and forms a handle on the drawer handle for grasping, pushing, and pulling the drawer 26 between the open and closed positions or to remove the drawer from the mounting unit.

A plurality of bosses or lugs is provided on the drawer 26, each protruding outward from the side panels 128 in this example. Each of the lugs is also positioned essentially at the top edge 134 in the disclosed example. Each side panel 128 has a rear lug 140*a* positioned closely adjacent the respective rear corners 129*b* on the sidewall 122. Each side panel 128 also has a forward lug 140*b* spaced forward from the respective rear lug 140*a* on its respective side panel. However, each of the forward lugs 140*b* is spaced significantly rearward of its corresponding front corner 129*a* on the side panels 128. In this example, each of the forward lugs 140*a* is positioned at about a midpoint along the side panels 128 between the front and back panels 126, 124. Each of the lugs 140 has a closed end face 142 and a semi-cylindrical outer surface 144 facing in a downward direction. Each of the lugs 140 is open on its top 146 so that the lugs can be hollow in order to save material.

Figure 10:
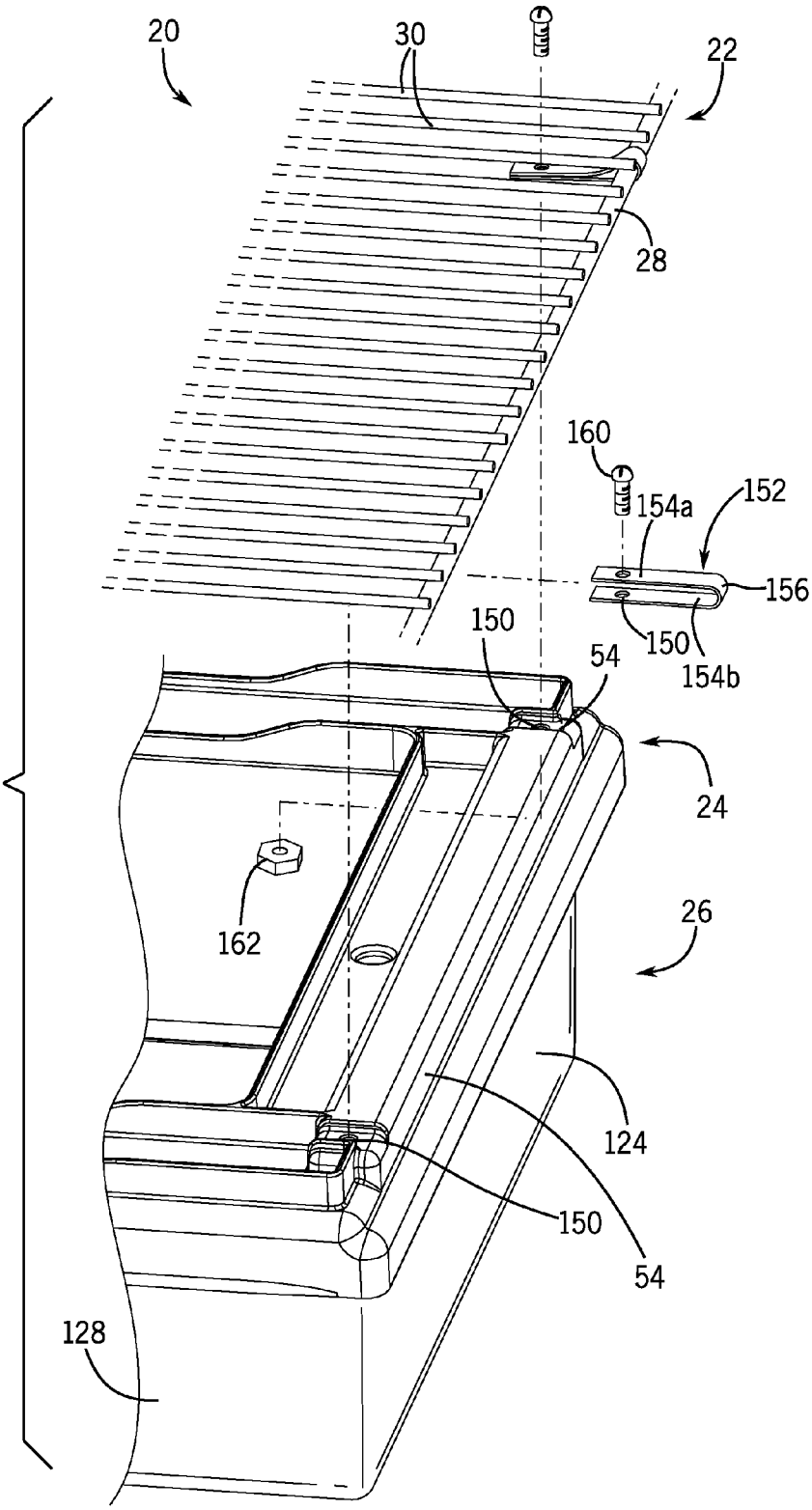
FIG. 10 shows an exploded, partial cutaway view of the drawer assembly shown in FIG. 1.
Figure 11:
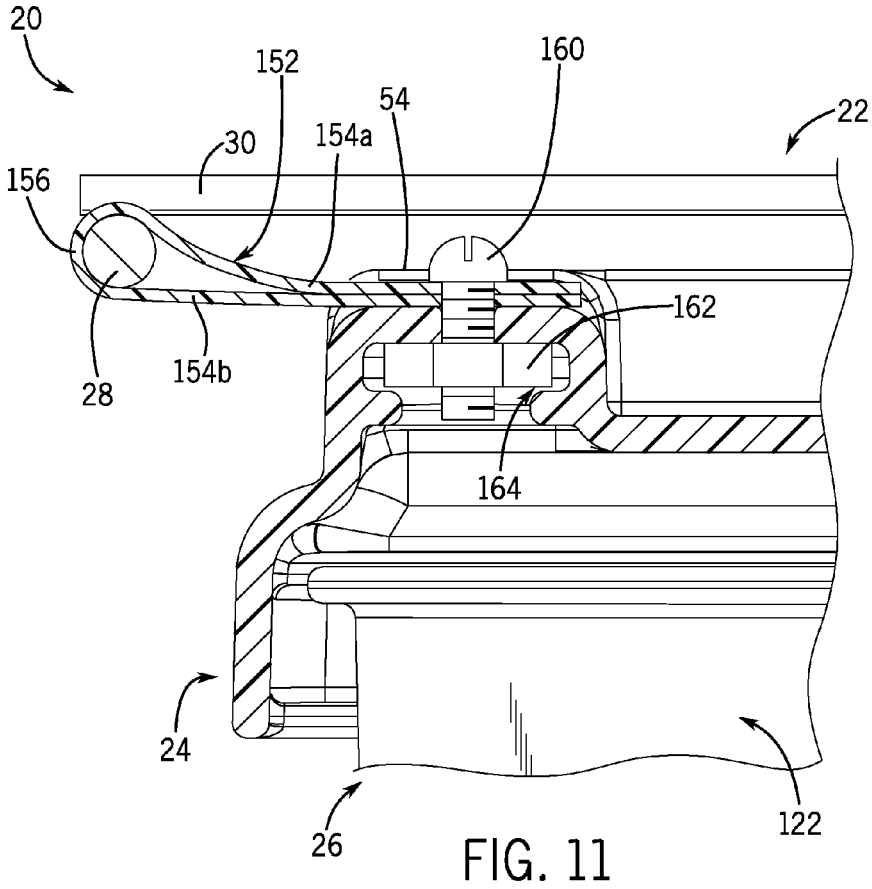
FIG. 11 shows a cross-section view taken along line 11-11 of the drawer assembly in FIG. 7.

With reference to FIGS. 5 and 9-11, the mounting unit 24 can be attached or mounted to the shelf 22 in any suitable manner, depending on the construction of the shelf. In this example, the bracket 46 is configured with a fastener through-hole 150 in each of the mounting pads 54. Thus, ordinary fasteners, such as wood screws, can be inserted through the through-holes 150 from the underside 52 to secure the bracket 46 to a solid wood shelf (not shown), if desired. The same through-holes 150 are utilized in this example to secure the mounting unit 24 to the wire shelf 22. A connector 152 is provided for each of the mounting pads 54 in this example. Each connector 152 is generally a resilient metal strap having an elongate U-shape. Each connector thus has two elongate legs 154*a* and 154*b* connected by a loop 156. The elongate legs 154*a*, 154*b* can be spread apart to slip the connector 152 onto one of the support wires 28 as shown in FIG. 10. A fastener hole 158 can be provided through each of the legs 154*a*, 154*b* and a fastener 160, i.e., a threaded bolt, can be inserted downward through each of the holes 158 in the connector 152 and also through the through-hole 150 as shown. In this example, a nut 162 can then be threaded onto the fastener 160 to secure each of the connectors 152 to the wires 28. In this manner, the mounting unit 24 can easily be mounted to the wire shelf 22. As shown in FIG. 11, a nut pocket 164 can be provided in the underside 52 of the bracket 46 at each of the corners 48*a* and 48*b* to securely hold the nuts 162 in place during installation. The various top edges of the ribs 56 and 60 and/or top surfaces of other parts of the top side 50 on the bracket 46 can be co-planar. The mounting unit 24 could then lie flush against an underside of a flat panel-type shelf. The mounting unit 24 could then alternatively be attached and secured using screws through the through holes 150 directly to such a shelf, if desired and as noted above.

Figure 12:
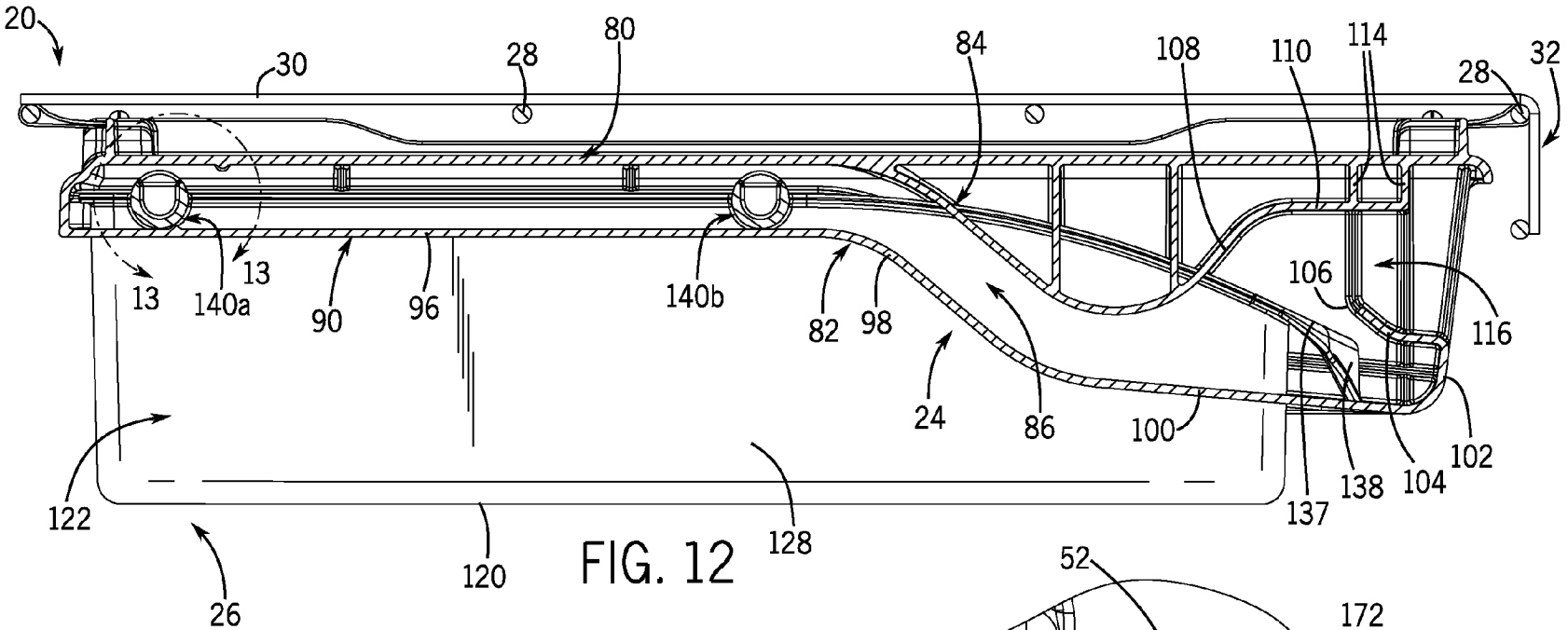
FIG. 12 shows a cross-section view taken along line 12-12 of the drawer assembly shown in FIG. 7 and with the drawer in the closed position of FIG. 1.
Figure 13:
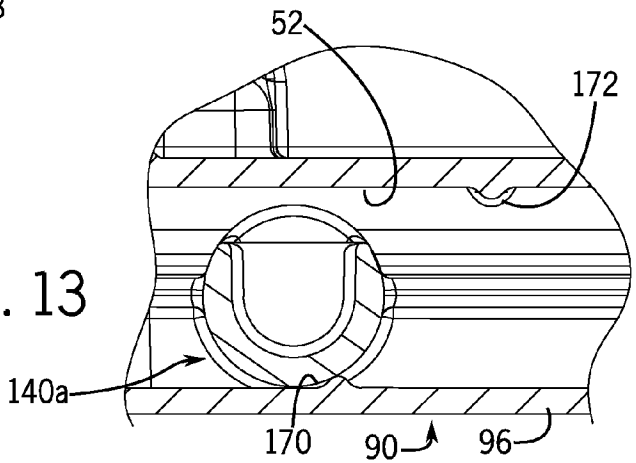
FIG. 13 shows an enlarged view of part of the drawer assembly shown in FIG. 12 and taken from circle 13-13 therein.
Figure 14:
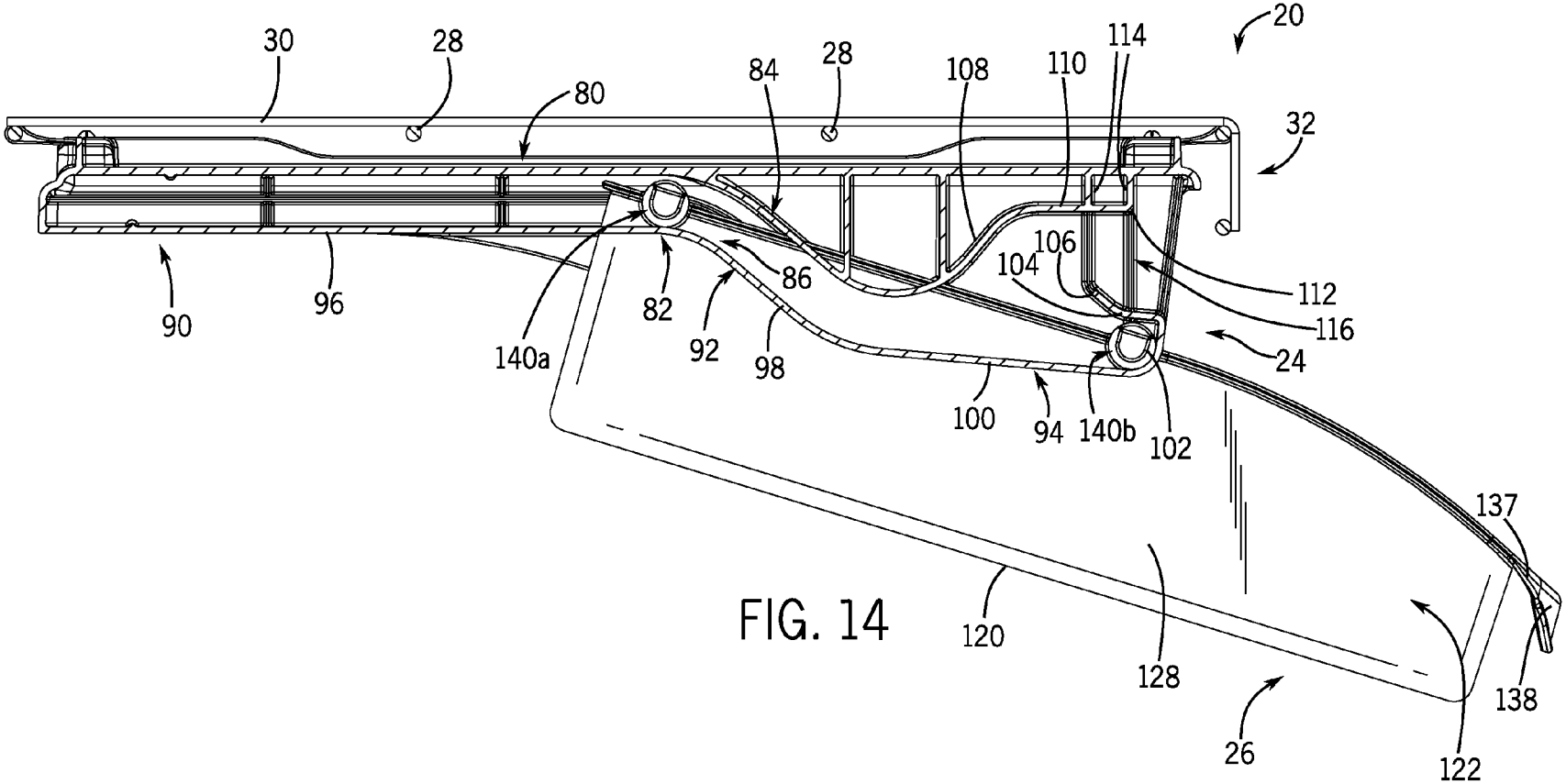
FIG. 14 shows the drawer assembly shown in FIG. 12, but with the drawer in the open position of FIG. 2.

Once the mounting unit 24 is attached or mounted to the shelf 22, the drawer 26 can then be installed on the mounting unit. With reference to FIGS. 12-14, the rear lugs 140*a* can be inserted through the front openings 116 in each of the tracks slots 86. The rear lugs 140*a* can be rested on the front section 100 of the lower guide 82. The drawer 26 can then be pushed rearward until the forward or front lugs 140*b* pass through the front openings 116 in the track slots 86. The front lugs 140*b* can then also be rested on the front segments 100 of the lower guides 82 (see FIG. 14). The drawer 26 can then be pushed all the way rearward until the rear lugs 140*a* reach a rear stop or the drawer 26 bottoms out against a part of the back panel 124 or some other stop surface.

As shown in FIG. 12, the drawer 26 is in the closed position when the drawer 26 is pushed to its rearward most position relative to the mounting unit 24. In this position, both the front and rear lugs 140*a*, 140*b* rest on the generally horizontal rear segment 96 of the lower guide 82 in the rear portion 90 of the tracks 80. In the closed position, the drawer 26, i.e., the bottom 120, is generally level and parallel with the shelf 22. In this example, the front and rear lugs 140*a*, 140*b* are also generally level with one another because the rear portions 90 of the track slots are also parallel to the shelf 22 or generally horizontally oriented. In other examples, both the track slots 86 and the lugs 140*a*, 140*b* can be inclined or declined relative to the drawer 26, and particularly the bottom 120. This can be so while still achieving a level bottom 120 or to achieve an unlevel bottom orientation, if desired. The orientation of the track slots 86 and the lugs 140*a*, 140*b* can compliment one another to achieve a desired arrangement of same and also a desired drawer orientation or angle.

As shown in FIG. 13, the tracks slots 86 can include one or more detents that can help retain the drawer 26 in the closed position, the open position, or both, if desired. The detents can also provide a tactile indication, an audible indication, or both to the user to indicate when the drawer is fully closed, fully open, and/or the like. In this example, a protrusion 170 extends upward from each lower guide 82 near the rear end of the rear segment 96. When the drawer is in the closed position as shown, the rear lugs 140*a* will pass beyond these protrusions 170. Also in this example a second protrusion 172 projects downward from the rear segment (underside 52 of the bracket 46) of the upper guide 84 and is spaced forward of the protrusion 170 on the lower guide 82. When the user wishes to move the drawer 26 from the closed position to the open position, the rear lugs 140*a* must rise slightly to get past the protrusions 170. The lugs 140*a* may bump up against the protrusions 172 has they pass, which may move the lugs downward. The protrusions 170 and 172 can give the user tactile information relative to the drawer position. The protrusions 172 can also assist in keeping the drawer in or near the closed position. The offset protrusions 170 and 172 in this example create a non-linear path of travel for the lugs 140*a*. This can help to prevent unintended opening of the drawer 26 as well as to assure that a user receives some indication of drawer position when opening or closing.

When the user moves the drawer 26 from the closed position of FIGS. 1 and 12 to the open position of FIGS. 2 and 14, they need only grasp the handle 138 and pull the drawer forward. The forward lugs 140*b* will ride within the track slots 86 along the lower guide 82. The drawer 26 will remain relatively level until the forward lugs 140*b* reach the inclined portion 92 of the slots 86. The forward lugs 140*b* will follow the track slots 86 through the incline portions 92. The forward lugs 140*b* will then begin to drop to a lower elevation in comparison to the rear lugs 140*a*, which are still riding along the rear portion 90 of the tracks 86. This will cause the front end of the drawer 26 to drop. The drawer 26 can be pulled outward until the forward lugs 140*a* contact the front ends 102 of the track slots. The forward lugs 140*a* will then be captured between the front segment 100 of the lower guide 82, the front stops 102, and the overlying vertical stops 104. The drawer 26 will be held in the open position and will be prevented by the front ends 102 from being pulled out of the mounting unit 24 unintentionally and will also be prevented from being unintentionally raised upward by the vertical stops 104. In the open position in this example, the rear lugs 140*a* rest at the very forward end of the rear portions 90 just prior to the track slots 86 transitioning to the inclined portion 92. This holds the drawer 26 tilted in a forward and downward orientation as shown. The front end of the drawer 26 is retained at a lower elevation than the rear end. This increases the size of the gap between the downturned face 32 on the shelf 22 and the top edge 132 of the front panel 26 on the drawer, which in turn increases the access area to the drawer when opened. The lower height of the front panel 126 (relative to the rest of the drawer sidewall 122) also helps to increase the size of the access opening. The downward angle of the drawer 26 also exposes the drawer contents to a user, even at eye level. The contents can this be more easily identified and more easily taken out of or replaced within the drawer 26.

To close the drawer 26, the user need only pushed the drawer back into the mounting unit 24. The lugs 140*a*, 140*b* will travel along the lower guide and be returned to their relatively level orientation of the closed position as depicted in FIGS. 1 and 12. If the user wishes to remove the drawer 26 from the mounting unit, they can pull the drawer toward the open position. They can then raise the front end of the drawer, including the forward lugs 140*b* upward to clear the distal ends 104 and front ends 102 of the track slots 86. The lugs are then free to pass through the front openings 116 and exit the track slots 86. The front lugs 140*b* and rear lugs 140*a* can each be similarly withdrawn through the front openings 116 to remove the drawer.

The lug ribs 88 can be provided to limit surface area contact between the lug end faces 142 and the ribs. This can reduce friction between the components, making the drawer easier to slide along the tracks 88. The ribs can vary from the continuous rib example shown herein. The ribs can be a discontinuous series of bumps, multiple parallel ribs, or the like.

The drawer assembly 20 described herein is but one example provided to illustrate aspects of the present invention. The configuration and construction of the shelf, mounting unit, and drawer can vary from the examples shown and yet fall within the scope of the present invention. The materials used to fabricate the components can also vary. The mounting unit and drawer can be molded from different types of plastic, hard rubber, or other suitable materials. The parts can alternatively be made having a wire form construction or can be made from sheet metal, if desired.

Figure 15:
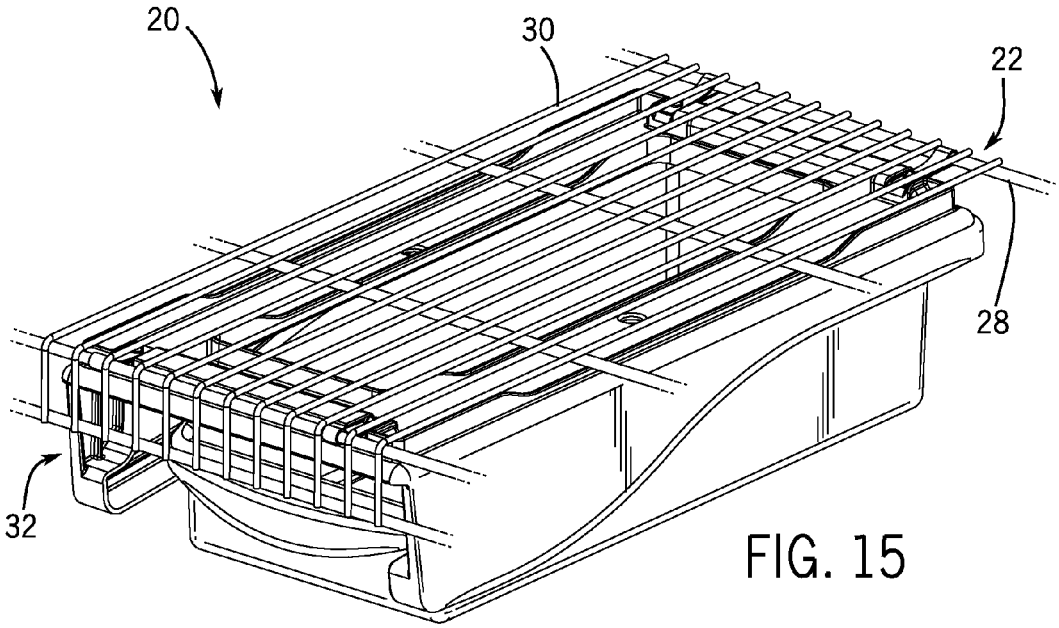
FIG. 15 shows a perspective view of an alternate example of a drawer assembly constructed in accordance with the teachings of the present invention, and with the drawer in a closed position.
Figure 16:
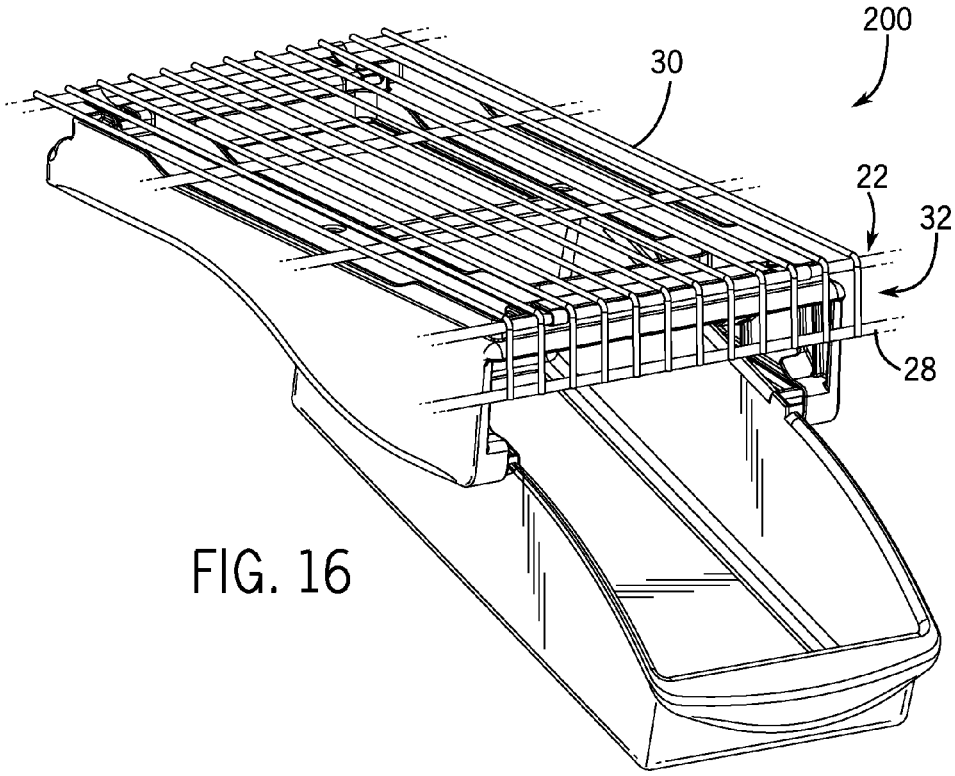
FIG. 16 shows the drawer assembly shown in FIG. 15, but with the drawer in an open position.

The shape and size of the drawer assembly 20 disclosed herein can also vary. FIGS. 15 and 16 illustrate an alternate example of a drawer assembly 200, which is essentially identical in construction to the drawer assembly 20 described above, except that it has a much narrower size. Other changes to the size, shape, and contour of the drawer assembly disclosed and described herein can be made within the scope of the present mention as well.

The configuration and construction of the tracks 80, as well as their shape and contour, can also vary. Also, the front and rear stop features, as well as the vertical stop features, can be provided using different components are structures and/or in a different manner than that described in the disclosed example for each of these stop features.

The lugs can be provided protruding inward from the side panels of the drawer. Likewise, the tracks can be provided facing outward on the drawer supports of the mounting unit. Similarly, the lugs can alternatively be provided as stationary parts on either the inside or outside surfaces of the drawer supports Likewise, the tracks can be provided on the inside or outside surfaces of the side panels on the drawer sidewall, if desired. The track contour and lug positions would have to be altered in order to achieve a desired drawer travel and orientation in each drawer position in such alternate examples.

Although certain drawer constructions have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A drawer assembly for mounting beneath a shelf, the drawer assembly comprising:

a drawer having a bottom, a front end, a rear end, and a pair of opposed side panels; and a mounting unit configured to mount to a shelf and having a pair of spaced apart drawer supports, the drawer supported by the drawer supports;

a pair of tracks laterally spaced apart on either the drawer side panels or the drawer supports, each of the pair of tracks having an upper guide, a lower guide with a relatively horizontal rear segment, a front segment at a lower elevation than the rear segment, and an inclined segment therebetween connecting the rear and front segments and gradually curving and transitioning from the rear segment to the front segment;

a track slot between the lower guide and the upper guide of each of the pair of tracks;

a pair of lugs protruding from each of the other of the drawer side panels or the drawer supports, each pair of lugs slidable relative to and along a respective one of the pair of tracks;

a front end of each of the lower guides curving upward to form a front stop at the front portion of the track slots;

a front segment of each of the upper guides spaced further upward from the front segment of the lower guide so that the track slots have a greater height within the front portion of the track slots than within the rear and inclined portions; and a gap between the front stop and the front segment of the upper guide to create clearance for the lugs permitting removal of the drawer, wherein the drawer is slidable between a closed position and an open position relative to the mounting unit, the pair of tracks and the pairs of lugs cooperating such that the front end and rear end of the drawer are substantially level with one another in the closed position and the front end is lower than the rear end in the open position.

2. A drawer assembly according to claim 1, wherein each pair of lugs further comprises a forward lug and a rear lug spaced apart from one another.

3. A drawer assembly according to claim 1, wherein each pair of lugs further comprises a forward lug and a rear lug spaced apart from one another and protruding outward from the side panels of the drawer.

4. A drawer assembly according to claim 3, wherein each rear lug is positioned adjacent the rear end of the drawer and each forward lug is positioned spaced from the both the respective rear lug and the front end of the drawer.

5. A drawer assembly according to claim 1, wherein each of the tracks is carried on an inside surface of a respective one of the drawer supports.

6. A drawer assembly according to claim 1, wherein each of the track slots has a rear portion, an inclined portion, and a front portion that correspond to the respective rear, inclined, and front segments of the lower guide, and wherein the rear portion and the inclined portion of the track slots have a contour determined by the respective rear and inclined segments.

7. A drawer assembly according to claim 1, wherein the drawer slides forward a predetermined distance from the closed position before the front end of the drawer begins to drop downward.

8. A drawer assembly according to claim 1, wherein the front end of each of the lower guides has a portion that extends rearward and is spaced above the lower guide forming a vertical stop whereby a corresponding one of the lugs is captured between the respective vertical stop and lower guide when the drawer is in the open position.

9. A drawer assembly for mounting beneath a shelf, the drawer assembly comprising:

a drawer having a bottom, a front end, a rear end, a pair of opposed side panels, and lugs protruding outward from each side panel; and a mounting unit configured to mount to a shelf and having a pair of tracks laterally spaced apart, the drawer supported by the mounting unit with the lugs on each side panel being slidable along a respective one of the pair of tracks, wherein each of the pair of laterally spaced apart tracks has a lower guide with a relatively horizontal rear segment, a front segment at a lower elevation than the rear segment, and an inclined segment therebetween connecting the rear and front segments and gradually curving and transitioning from the rear segment to the front segment, a front end of each of the lower guides that curves upward to form a front stop at the front portion of the track slots, an upper guide defining a track slot between the lower guide and the upper guide, a front segment of each of the upper guides that is spaced further upward from the front segment of the lower guide so that the track slots have a greater height within the front portion of the track slots than within the rear and inclined portions, and a gap between the front stop and the front segment of the upper guide to create clearance for the lugs permitting removal of the drawer, wherein the drawer is slidable between a closed position and an open position relative to the mounting unit, the bottom being substantially level in the closed position and being tilted downward from the rear end toward the front end in the open position.

10. A drawer assembly according to claim 9, wherein the front end of each of the lower guides has a vertical stop that extends rearward and spaced above the lower guide whereby a corresponding one of the lugs is captured between the respective vertical stop and lower guide when the drawer is in the open position.

* * * * *